United States Patent [19]

Brunner et al.

[11] Patent Number: 4,502,919

[45] Date of Patent: Mar. 5, 1985

[54] PLANT FOR EXTRACTING CRUDE OIL FROM OIL SHALE

[75] Inventors: Gerd Brunner, Roth; Rainer Hoffmann, Nuremberg; Konrad Künstle, Röttenbach, all of Fed. Rep. of Germany

[73] Assignee: Kraftwerk Union Aktiengesellschaft, Mülheim an der Ruhr, Fed. Rep. of Germany

[21] Appl. No.: 540,192

[22] Filed: Oct. 7, 1983

[30] Foreign Application Priority Data

Oct. 11, 1982 [DE] Fed. Rep. of Germany ..... 3237647

[51] Int. Cl.[3] ..... B01D 11/02; C10B 53/06; C10G 1/06

[52] U.S. Cl. ..... 196/14.52; 196/120; 202/84; 422/232

[58] Field of Search ..... 196/14.52, 46, 120; 202/84, 107, 209; 422/140, 232, 233; 208/11 LE

[56] References Cited

U.S. PATENT DOCUMENTS

| | | | |
|---|---|---|---|
| 3,297,562 | 1/1967 | Biddick et al. . | |
| 3,475,319 | 10/1969 | MacLaren . | |
| 3,617,469 | 11/1971 | Schlinger et al. . | |
| 3,617,472 | 11/1971 | Schlinger et al. . | |
| 3,968,030 | 7/1976 | Cros | 196/120 |
| 4,098,648 | 7/1978 | Kraemer et al. | 196/14.52 |
| 4,212,652 | 7/1980 | du Pont | 422/232 |
| 4,275,034 | 6/1981 | Friedman et al. | 422/232 |

FOREIGN PATENT DOCUMENTS 2429767 1/1976 Fed. Rep. of Germany .

*Primary Examiner*—Bradley Garris

*Attorney, Agent, or Firm*—Herbert L. Lerner; Laurence A. Greenberg

[57] ABSTRACT

An arrangement for extracting crude oil from oil shale comprising: a low temperature carbonization reactor; a processing means for feeding a slurry of oil shale, solvent and hydrogen into the low temperature carbonization reactor; a separating means for separating the resulting gaseous low temperature carbonization mixture from the used oil shale and for separating the low temperature carbonization mixture into gaseous and liquid low temperature carbonization products; a gas turbine the exhaust gas outlet of which is connected to two heat exchangers, one of which heat exchangers is disposed in a circulation system for a scavenging gas, which circulation system includes a separating reactor (which forms part of said separating means) in which in use the scavenging gas flows upwardly in counterflow to the oil shale for separation of the fluid low temperature carbonization mixture from the used oil shale, and the other of which heat exchangers is disposed between the low temperature carbonization reactor and said separating reactor; the low temperature carbonization reactor including a fluidizing cooler with a fluidized bed means for feeding used oil shale from the separating reactor to the fluidized bed and means for feeding turbine exhaust gas from either or both of said two heat exchangers to the fluidized bed for fluidizing the bed.

7 Claims, 1 Drawing Figure

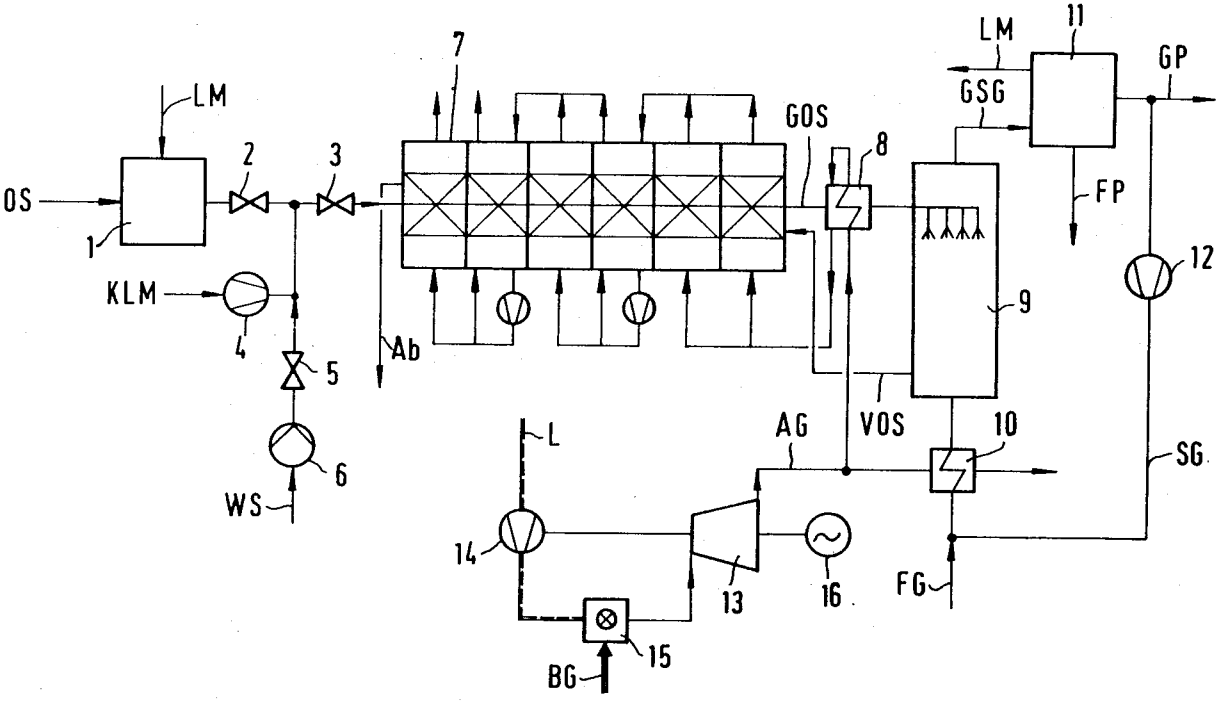
OS
LM
1
2
3
KLM
4
5
6
WS
7
Ab
GOS
8
LM
GSG
11
GP
FP
9
12
SG
10
VOS
FG
AG
16
13
15
BG
L
14

PLANT FOR EXTRACTING CRUDE OIL FROM OIL SHALE

BACKGROUND OF THE INVENTION

1. Field of the Invention

This invention relates to the extraction of crude oil from oil shale by hydrogenating low-temperature carbonization of oil shale.

2. Description of the Prior Art

In oil sands and oil shale, considerable reserves of crude oil are stored. The extraction of crude oil from these reserves is expensive. Efforts are being made, therefore, to develop less expensive processes for such extraction.

In a known method of extracting oil from oil shale, as disclosed in U.S. Pat. No. 3,617,472, the shale is subjected to hydrogenating low temperature carbonization in a reactor. In this process, carbon monoxide and hydrogen, which are produced by the partial oxidation of gaseous by-products of the separating process, act upon the shale, which has been mechanically prepared. In order to improve the yield of crude oil, water or steam can be additionally supplied to the reactor. In another known method, as disclosed in U.S. Pat. No. 3,617,469, the oil shale, in finely ground form, is first mixed with a heavy oil to form a slurry, the heavy oil emanating from the extraction process itself and being an aromatic solvent. Following the hydrogenating low temperature carbonization, which takes place under pressure, the gaseous low temperature carbonization mixture is first separated from the used oil shale and, subsequently, the gaseous low temperature carbonization mixture is separated into gaseous and liquid low temperature carbonization products and also water. Hydrogen in the gaseous products is recycled. In order to recover the heat which is contained in the used oil shale, it is further known to pass the oil shale through a cooling zone (U.S. Pat. No. 3,475,319) or to mix it with fresh oil shale (German Offenlegungsschrift No. 2,429,767).

SUMMARY OF THE INVENTION

An object of the invention is to improve the energy balance of the overall arrangement by recovering the heat which is not used in the course of the low temperature carbonization process and by exploiting the energy contained in the gaseous products of the low temperature carbonization process.

With the foregoing and other objects in view, there is provided in accordance with the invention a plant for extracting crude oil from oil shale comprising a low temperature carbonization reactor for effecting hydrogenating low temperature carbonization of oil shale under pressure; a processing means, upstream of the low temperature carbonization reactor, for processing the oil shale, in particulate form, by mixing it with a liquid solvent and with hydrogen to form a slurry in which the oil shale is dispersed in the solvent containing dissolved hydrogen, and for feeding the slurry into the low temperature carbonization reactor; a separating means, downstream of the low temperature carbonization reactor, for separating the reaction products from the reactor into a gaseous low temperature carbonization mixture containing solvent and spent oil shale and for separating the gaseous low temperature carbonization mixture into gaseous and liquid low temperature carbonization products and solvent; a return means for recycling said solvent separated from the reaction products from the reactor to said processing means; a gas turbine for the supply of energy to the plant, with the exhaust gas outlet of the gas turbine connected to two heat exchangers, a circulation system for a scavenging gas, which circulation system includes a separating reactor which forms part of said separating means in which in use the scavenging gas flows upwardly in counterflow to the oil shale for separation of the fluid low temperature carbonization mixture from the spent oil shale, one of said two heat exchangers being disposed in the circulation system to effect heating of the scavenging gas prior to its entrance into the separating reactor, the other of said two heat exchangers disposed between the low temperature carbonization reactor and the separating reactor to effect heating of the reaction products from the low temperature reactor prior to entrance into the separating reactor; said low temperature reactor including a fluidizing cooler with a fluidized bed, transfer means for feeding spent oil shale from the separating reactor to the fluidized bed of the fluidized cooler, and feeding the turbine exhaust gas from at least one of said two heat exchangers to the fluidized bed of the fluidizing cooler for fluidizing the bed.

Other features which are considered as characteristic for the invention are set forth in the appended claims.

Although the invention is illustrated and described herein as embodied in a plant for extracting crude oil from oil shale, it is nevertheless not intended to be limited to the details shown, since various modifications may be made therein without departing from the spirit of the invention and within the scope and range of equivalents of the claims.

BRIEF DESCRIPTION OF THE DRAWING

The invention, however, together with additional objects and advantages thereof will be best understood from the following description when read in connection with the accompanying drawing which diagrammatically illustrates a plant for extracting crude oil from oil shale involving a low-temperature carbonization reactor including a fluidizing cooler with a fluidized bed, processing means for forming a slurry of oil shale in solvent, dissolving hydrogen in the solvent, and feeding the slurry to the low temperature reactor. The reaction products are separated into gaseous products, liquid products and spent shale. Part of the gaseous products are circulated to the separator to scavenge the shale to separate the fluid reaction products. A gas turbine supplies energy to the plant. Exhaust gas from the turbine passes through a heat exchanger to heat the scavenger gas and to another heat exchanger to heat the reaction products before entering the separator. The spent shale from the separator is sent to the fluidized bed in the low temperature reactor where it gives up its heat to the slurry containing incoming oil shale. The spent shale, after giving up heat to the slurry, is discharged from the reactor. Part of the gaseous products may be used as fuel for the gas turbine.

DETAILED DESCRIPTION OF THE INVENTION

According to the present invention, there is provided an arrangement for extracting crude oil from oil shale, comprising a low temperature carbonization reactor for effecting the hydrogenating low temperature carbonization of the oil shale under pressure; a processing means, upstream of the low temperature carbonization reactor, for processing the oil shale, in particulate form, by mixing it with a solvent and with hydrogen and for feeding the resulting oil shale slurry into the low temperature carbonization reactor; a separating means, downstream of the low temperature carbonization reactor, for separating the resulting gaseous low temperature carbonization mixture from the used oil shale and for separating the low temperature carbonization mixture into gaseous and liquid low temperature carbonization products; and a means for recycling the solvent to the processing means; wherein the arrangement includes, for the supply of energy thereto, a gas turbine the exhaust gas outlet of which is connected to two heat exchangers, one of which heat exchangers is disposed in a circulation system for a scavenging gas, which circulation system includes a separating reactor (which forms part of said separating means) in which in use the scavenging gas flows upwardly in counterflow to the oil shale for separation of the fluid low temperature carbonization mixture from the used oil shale, and the other of which heat exchangers is disposed between the low temperature carbonization reactor and said separating reactor; and wherein the low temperature carbonization reactor comprises a fluidizing cooler, the arrangement including means for feeding used oil shale from said separating reactor to the fluidized bed of the fluidizing cooler and means for feeding turbine exhaust gas from either or both of said two heat exchangers to the fluidized bed of the fluidizing cooler for fluidizing the bed.

By virtue of the arrangement of the invention, the rational use of energy is coupled with a high yield, thereby removing the need for any subsequent combustion of the oil shale carbonized at low temperature. Low temperature carbonization of the oil shale, which takes place under pressure, is carried out such that, in the liquid state of the solvent, there is very efficient extraction from the oil shale, and that the low temperature carbonization products change into the gaseous phase only at the outlet of the end stage of the fluidizing cooler, by the formation of a supercritical state. Accordingly, the scavenging of the low temperature carbonization products by the scavenging gas is substantially facilitated. Moreover, further low temperature carbonization under hydrogenating conditions takes place in the separating reactor under the action of the scavenging gas, which results in a very low residual carbon content of the shale. The liquid state of the solvent in the low temperature carbonization reactor also makes certain that the hydrogen necessary for low temperature carbonization rapidly becomes effective. Furthermore, the liquid state of the solvent ensures successful transfer of heat from the fluidized bed to the oil shale, which latter is transported as a slurry through the fluidizing cooler.

In a preferred embodiment of the invention, the burner or burners of the gas turbine are fed with at least part of the gaseous low temperature carbonization products.

A schematic representation of an arrangement of the invention will now be described, by way of example, with reference to the drawing. The arrangement consists of known units which have a new functional interrelationship.

In the center of the arrangement is located a low temperature carbonization reactor 7 wherein the oil shale is rendered soluble. The reactor is a fluidizing cooler of known construction, and has one or more pipes for receiving oil shale. A processing device which includes a mixer 1, two valves 2 and 3 and a hydraulic pump 4 is connected upstream of the low temperature carbonization reactor 7. There is connected downstream of the low temperature carbonization reactor 7 a separating device including a separating reactor 9, for separating the gaseous low temperature carbonization products from the used oil shale, and including a separator 11 for separating the liquid and gaseous reaction products. The entire arrangement is supplied with energy by a gas turbine 13 which drives a compressor 14 and an electrical generator 16. The exhaust gases of the gas turbine 13 are directed to a heat exchanger 10 and to a heat exchanger 8 and then to the fluidized bed of the low temperature carbonization reactor 7.

When the arrangement is in operation, finely ground oil shale OS which has a particle size of less than 5 mm is mixed in the mixer 1 with an aromatic solvent LM, for example benzene or toluene, which is extracted in the course of the processing of the oil shale, thereby producing an easily conveyable slurry. The oil shale slurry produced in this way is pumped into the low temperature carbonization reactor 7, in which there is a pressure of approximately 30 to 100 bar. The two valves 2 and 3 and also the pump 4, which is connected via a T-piece to a by-pass line and which has hydraulic pistons, are provided as a conveying means. The pump 4 is supplied with cold or fresh solvent KLM. A valve 5 for the supply of hydrogen WS by means of a pump 6 is also provided in the by-pass line.

The hydrogen WS is added to the mixture of oil shale OS and solvent LM in such quantities that all of the hydrogen dissolves in the liquid phase of the oil shale slurry at the chosen low temperature carbonization pressure and at the temperature at the inlet of the low temperature carbonization reactor 7. Inside the low temperature carbonization reactor 7 and the heat exchanger 8 connected to it, the pressure and temperature are such that the solvent and the hydrogen continue to remain dissolved in the kerogen of the oil shale and in the low temperature carbonization products.

The temperature of the heated low temperature carbonization reactor and the residence time of the oil shale slurry are such that the solubilization of the oil shale is essentially terminated through the cracking of the kerogen at the end of the low temperature carbonizatiion reactor 7 and in the heat exchanger 8. When the oil shale GOS, carbonized at low temperature, passes into the separating reactor 9, the temperature of the oil shale is increased by the heat exchanger 8 such that, when a scavenging gas SG is added in the separating reactor 9, the resulting mixture of scavenging gas, low temperature carbonization gas, solvent and low temperature carbonization products remains in the supercritical state.

After the carbonized oil shale GOS has passed through the heat exchanger 8, it is fed to the separating reactor 9 via several pipes, thereby producing a uniform distribution of the material supplied. The scavenging gas is forced by the pump 12 into the bottom of reactor 9 and flows from the bottom to the top in the separating reactor 9. The scavenging gas SG consists essentially of hydrogen and of gaseous solvents which have been extracted from the product. If desired, the scavenging gas may be mixed with fresh gas FG, before it is heated in the heat exchanger 10. In the separating reactor 9, the scavenging gas removes, from the oil shale carbonized at low temperature, solvent and low temperature carbonization products and carries these out of the separating reactor 9. The resulting low temperature carbonization mixture GSG passes to the separator 11 wherein it is separated into solvent LM, gaseous products GP and liquid products FP in accordance with known methods. A portion of the gaseous products is returned as low temperature carbonization gas SG to the separating reactor 9, by means of a pump 12.

In the separating reactor 9, the oil shale, carbonized at low temperature, sinks downwards from the point of entry in the flowing scavenging gas, with the as yet unconverted kerogen. The greater part of the residual kerogen which is still present is converted, and the low temperature carbonization products are dissolved in the scavenging gas and are carried along by it.

The spent shale VOS, carbonized at low temperature, is taken from the separating reactor 9 at the bottom and is supplied to the fluidized bed of the low temperature carbonization reactor 7 as fluidized material. The hot spent oil shale radiates its heat to the oil shale which is freshly introduced into the low temperature carbonization reactor, and the spent shale leaves the low temperature carbonization reactor as waste Ab. The cooled spent oil shale is mixed with water to produce steam and the surplus water is separated and recycled.

Fluidization of the fluidized bed in the low temperature carbonization reactor 7 is effected by the use of exhaust gases which are cooled in the heat exchanger 8 and which are forced through the fluidized zones, arranged in tandem, of the low temperature carbonization reactor with the aid of blowers. An effective transfer of heat from the fluidized bed to the oil shale which has been introduced, and uniform distribution and mixing of oil shale, solvent and low temperature carbonization gas in the low temperature carbonization reactor, are ensured by advantageously providing its pipe or each of its pipes internally with mechanically operated agitating elements.

The entire arrangement is supplied with energy via the gas turbine 13 which drives the air compressor 14 and the electrical generator 16, and to the burners 15 to which combustible gases BG and air L are supplied. The combustible gases are advantageously gaseous products GP of the low temperature carbonization process. An additional furnace may be employed which provides separate combustion gases. By appropriate selection of the low temperature carbonization temperature, it is possible to produce the amount of gas required, since with an increase in the low temperature carbonization temperature, there is an increase in the amount of gas during low temperature carbonization. If electrical power is required, then by increasing the low temperature carbonization temperature, the yield of gas is increased sufficiently to produce electrical power.

The foregoing is a description corresponding, in substance to German application No. P 32 37 647.2, dated Oct. 11, 1982, international priority of which is being claimed for the instant application, and which is hereby made part of this application. Any material discrepancies between the foregoing specification and the specification of the aforementioned corresponding German application are to be resolved in favor of the latter.

We claim:

1. A plant for extracting crude oil from oil shale comprising a low temperature carbonization reactor for effecting hydrogenating low temperature carbonization of oil shale under pressure; a processing means, upstream of the low temperature carbonization reactor, for processing the oil shale, in particulate form, by mixing it with a liquid solvent and with hydrogen to form a slurry in which the oil shale is dispersed in the solvent containing dissolved hydrogen, and for feeding the slurry into the low temperature carbonization reactor; a separating means, downstream of the low temperature carbonization reactor, for separating the reaction products from the reactor into a fluid low temperature carbonization mixture containing solvent and spent oil shale and for separating the fluid low temperature carbonization mixture into gaseous and liquid low temperature carbonization products and solvent; a return means for recycling said solvent separated from the reaction products from the reactor to said processing means; a gas turbine for the supply of energy to the plant, with the exhaust gas outlet of the gas turbine connected to two heat exchangers, a circulation system for a scavenging gas, which circulation system includes a separating reactor which forms part of said separating means in which in use the scavenging gas flows upwardly in counterflow to the oil shale for separation of the fluid low temperature carbonization mixture from the spent oil shale, one of said two heat exchangers being disposed in the circulation system to effect heating of the scavenging gas prior to its entrance into the separating reactor, the other of said two heat exchangers disposed between the low temperature carbonization reactor and the separating reactor to effect heating of the reaction products from the low temperature reactor prior to entrance into the separating reactor; said low temperature reactor including a fluidizing cooler with a fluidized bed, transfer means for feeding spent oil shale from the separating reactor to the fluidized bed of the fludizing cooler, and feeding the turbine exhaust gas from at least one of said two heat exchangers to the fluidized bed of the fluidizing cooler for fluidizing the bed.

2. A plant according to claim 1, including means for feeding at least part of the gaseous low temperature carbonization product separated in the separating means to a burner of the gas turbine.

3. A plant according to claim 1, wherein the processing means includes a hydraulic pump for receiving and pumping fresh solvent, the pump being connected, via a T-piece, to a supply line for the supply of oil shale to the low temperature carbonization reactor, between two valves disposed in said supply line.

4. A plant according to claim 3, including means for feeding at least part of the gaseous low temperature carbonization product separated in the separating means to a burner of the gas turbine.

5. A plant according to claim 1, wherein the separating reactor includes a plurality of pipes for the introduction of oil shale subjected to low temperature carbonization into the separating reactor.

6. A plant according to claim 5, wherein the processing means includes a hydraulic pump for receiving and pumping fresh solvent, the pump being connected, via a T-piece, to a supply line for the supply of oil shale to the low temperature carbonization reactor, between two valves disposed in said supply line.

7. A plant according to claim 5, including means for feeding at least part of the gaseous low temperature carbonization product separated in the separating means to a burner of the gas turbine.

* * * * *